United States Patent [19]

Pond, Sr. et al.

[11] 4,170,257

[45] Oct. 9, 1979

[54] METHOD AND APPARATUS FOR PRODUCING FILAMENTARY ARTICLES BY MELT EXTRACTION

[75] Inventors: Robert B. Pond, Sr., Westminster; John M. Winter, Jr., New Windsor; Bruce S. Tibbetts, Taneytown, all of Md.

[73] Assignee: National Standard Company, Niles, Mich.

[21] Appl. No.: 883,172

[22] Filed: Mar. 3, 1978

[51] Int. Cl.[2] ..... B22D 11/06

[52] U.S. Cl. ..... 164/87; 164/423; 164/429; 164/348

[58] Field of Search ..... 164/87, 427, 423, 429, 164/348; 264/8, 164, 165; 425/8

[56] References Cited

U.S. PATENT DOCUMENTS

| | | | |
|---|---|---|---|
| 3,863,700 | 2/1975 | Bedell et al. | 164/87 |
| 4,016,925 | 4/1977 | Sumida | 164/87 |

*Primary Examiner*—Robert D. Baldwin
*Assistant Examiner*—K. Y. Lin
*Attorney, Agent, or Firm*—Bacon & Thomas

[57] ABSTRACT

A method and apparatus for producing filamentary articles from an open bath of molten material. A quench wheel having a peripheral chill surface is rotated upon the surface of a portion of the bath provided with a baffle that defines a puddle of molten material free from fluid turbulence, thereby permitting high production rates and precise control of product configuration.

28 Claims, 14 Drawing Figures

PRIOR ART

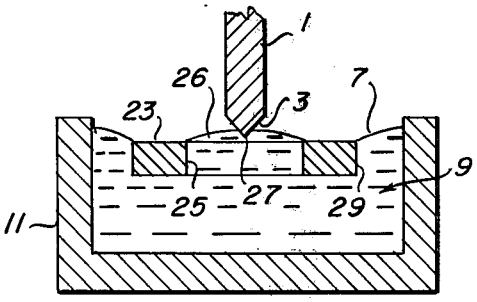
Fig. 9
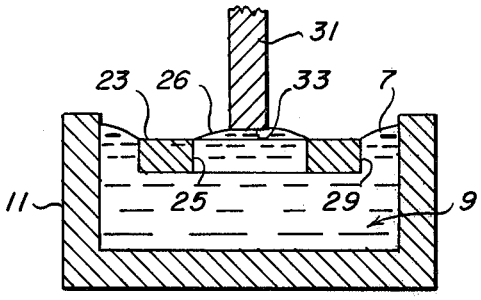
Fig. 10
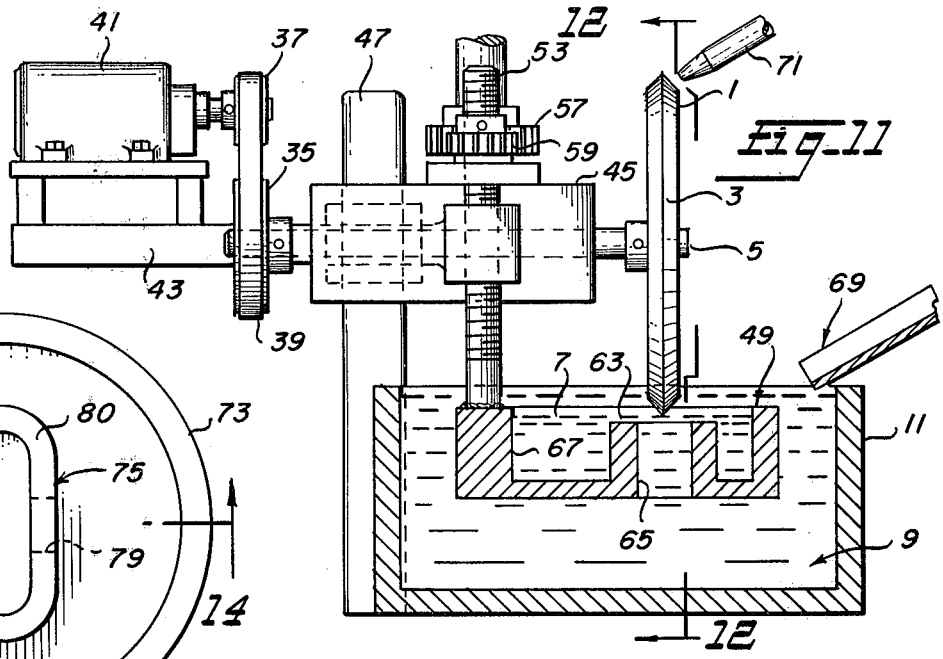
Fig. 11
Fig. 13
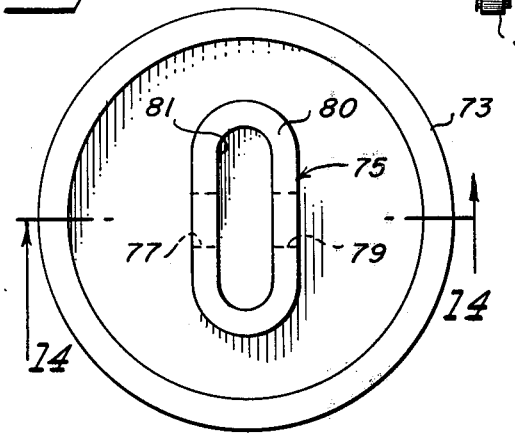
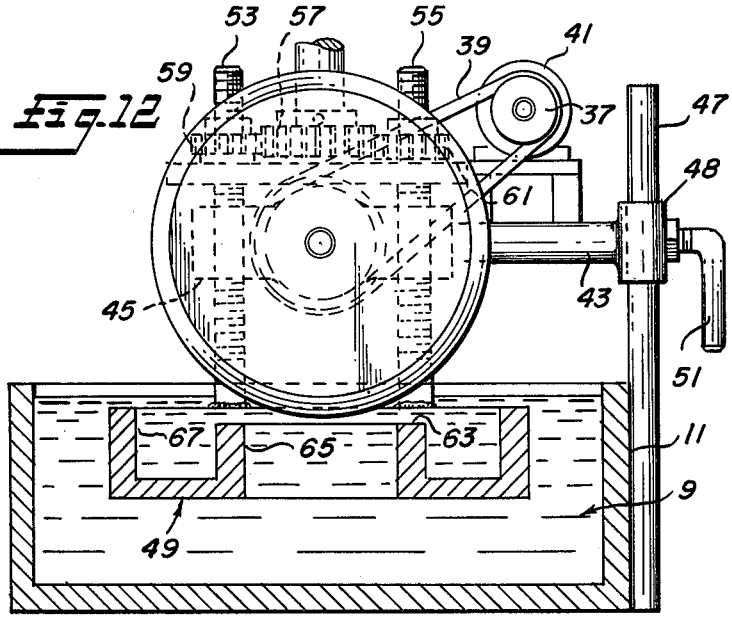
Fig. 12
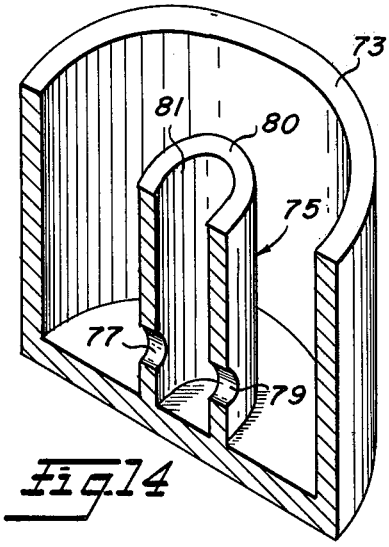
Fig. 14

METHOD AND APPARATUS FOR PRODUCING FILAMENTARY ARTICLES BY MELT EXTRACTION

BACKGROUND OF THE INVENTION

1. Field of the Invention

This invention relates generally to the production of filamentary articles by melt extraction from a molten source. More specifically, the invention is directed to a method and apparatus for the production of continuous or discrete lengths of metal filaments by extracting the filaments from a molten bath of the metal with a rotating quench wheel.

2. Description of the Prior Art

The prior art is replete with systems by which continuous and noncontinuous lengths of filamentary articles are formed by melt extraction from a source of molten material through the use of a rotating quench wheel. This is basically achieved by contacting the surface of the bath with the peripheral chill edge or surface of the quench wheel which immediately removes heat from the molten material in contact therewith. This promotes solidification of the material upon the wheel, which solidified material is then continuously thrown from the periphery of the wheel by centrifugal force in the form of a discrete or continuous length filament.

The quench wheel utilized in such systems may assume various peripheral surface configurations, depending upon the desired configuration of the filamentary product. For example, the peripheral edge of the wheel may have a V-shaped configuration for producing wire or other filamentary articles having a small cross-sectional area. A quench wheel having a cylindrical shape will present a wide chill surface to the molten bath, thereby producing filamentary articles having flat configurations, such as ribbons or sheets. By providing the chill edge of the quench wheel with spaced notches or indentations, discrete filamentary articles having lengths equal to the peripheral distances between the notches may also be produced.

In addition to the shape of the periphery of the quench wheel, there are several other factors which serve to control the configuration of the filaments formed by the quench wheel in the practice of the melt extraction technique. These factors include the speed of rotation of the quench wheel, the temperature differential between the quench wheel and the molten bath, and the depth of immersion of the quench wheel chill surface into the bath. However, careful control of these operating parameters often do not provide the desired results, particularly in situations wherein it is desired to continuously extract a filament at high speeds from a molten bath of high melting point metal, such as steel.

The centrifugal motion of the quench wheel imparts a flinging action that serves to both remove the solidified filament from the wheel and also induce a whipping motion in the filament which sometimes causes breakage of the filament and prevents the formation of a continuous length thereof. Another problem inherent in melt extraction procedures is the formation of oxides and other undesirable reaction products in the area of the melt directly in contact with the quench wheel.

Still another problem encountered with melt extraction systems, and probably the most significant, is the inevitable fluid turbulence or bath instability which is created by the rotating quench wheel. This turbulence is directly proportional to the rotational velocity of the quench wheel and, at sufficiently high rotational velocities, causes the bath to form a surge wave which actually becomes free standing and moves away from the chill surface of the quench wheel. This undesirable situation naturally prevents the quench wheel from functioning in its intended chilling capacity and terminates the formation of the desired filament. As is therefore apparent, the rate of production of filamentary articles by the utilization of the quench wheel in the practice of the melt extraction technique is critically dependent upon the rotational velocity of the quench wheel. This velocity has heretofore been severely limited by the turbulence and other undesirable fluid dynamics realized in molten baths, particularly baths of molten metals.

The prior art has attempted to overcome the many problems, including bath instabilities, associated with the practice of melt extraction by adopting a variety of techniques and procedures. Melt extraction as presently known can broadly be classified into two basic categories.

The first category includes those systems utilizing an orifice for feeding molten material directly to the quench wheel. The early British Pat. No. 20,518 to Strange taught that metal strips or sheets may be produced by rotating the chill surface of a quench cylinder or disc against a meniscus of molten metal formed at the orifice of a molten metal supply channel. The metal is caused to be fed through the channel and come into contact with the quench surface at which point it is continuously formed into the solidified product and removed. This basic orifice technique is also disclosed by the more recent Bedell et al U.S. Pat. No. 3,863,700 wherein melt extraction of molten metal is achieved by elevating the melt through capillary action between two spaced solid members disposed in the melt. In this manner, an elevated concave meniscus is formed between the solid members for contact by the quench wheel. Bedell et al discloses that the use of this capillary action is advantageous in maintaining a constant height of melt for contact by the quench wheel and thereby stabilize the melt level against undesirable fluid dynamics such as turbulence or fluctuations in melt volume.

However, it has been recognized that the basic orifice technique is not without disadvantages, particularly when it is utilized with higher melting point molten metals. Under such circumstances, the materials making up the orifice can react with the higher temperature molten metal or the surrounding atmosphere, thereby degrading the properties and the dimensional integrity of the orifice material. The size and shape of the orifice thus tends to erode and provide products having nonuniform configurations. Moreover, the insoluble refractory materials making up the molten metal container or channel tend to erode and clog the orifice. The use of an orifice usually requires additional heating to insure that metal does not solidify in the relatively small opening. Further, the use of small orifices requires extremely clean melts to prevent intermittent plugging or restriction of the meniscus forming opening.

The second category of melt extraction systems comprise those which utilize a free or open bath of molten material. The rotating quench wheel is caused to contact or "kiss" the free open surface of the melt in the absence of any confining or constricting appliance other than the main container holding the melt. Examples of methods and apparatus utilizing the open bath concept are disclosed by the Stewart et al U.S. Pat. No. 3,812,901, Kavesh U.S. Pat. No. 3,856,074, Mobley et al U.S. Pat. No. 3,861,450 and Maringer et al U.S. Pat. No. 3,904,344. The use of an open bath for contact by the quench wheel presents an unrestricted environment for fluid turbulence resulting from the pumping action created by the rotation of the quench wheel in the melt. Accordingly, the rate of production of filaments by quench wheels operating in an open bath is limited to the corresponding quench wheel rotation velocities below that which would otherwise cause undue turbulence of the cresting melt wave away from the quench wheel.

The present invention provides an improved method and apparatus for the melt extraction of a filamentary article from a molten bath without the disadvantages of heretofore known melt extraction techniques.

It is an object of the invention to provide an improved melt extraction system forming filamentary articles at extremely high production rates.

It is another object of the invention to provide an improved melt extraction system which is capable of rapidly producing both continuous and discrete filamentary articles having a variety of cross-sectional configurations.

It is yet another object of the invention to provide an improved melt extraction method and apparatus for rapidly producing a filamentary article of uniform dimension, size and configuration.

It is yet still another object of the invention to provide an improved method and apparatus for melt extraction wherein the turbulence and other undesirable fluid dynamics of the melt bath are positively controlled to permit rapid production of filamentary articles through high quench wheel rotational velocities.

SUMMARY OF THE INVENTION

The invention achieves the foregoing and other objects by providing an improved method and apparatus for melt extraction which utilize a baffle disposed beneath the surface of an open melt bath for preventing the cresting wave produced by the rotating quench wheel from moving away from the chill surface of the wheel and thereby losing contact therewith. The baffle serves to control fluid turbulence created by the rotating quench wheel and permits higher than heretofore utilized quench wheel rotational velocities to produce filamentary articles at correspondingly higher production rates. A preferred embodiment of the invention comprises utilizing a channel-shaped baffle having an opening which forms a puddle of the melt within the area defined by the perimeter of the opening when the melt is contacted by the rotating quench wheel. The puddle presents a controlled feed of melt that is rapidly removed by the quench wheel. The finite area represented by the puddle is in the form of a meniscus which is free from fluid turbulence and accumulation of undesirable reaction products, such as oxides.

An apparatus for utilizing the baffle of the invention may incorporate the quench wheel and baffle as an assembly that is disposable as a single unit into the melt bath. Alternatively, the baffle may be disposed in a stationary manner within the melt bath and the quench wheel be moved towards and away from the baffle.

Other objects, features and advantages of the invention will be apparent from the following description of specific embodiments thereof, with reference to the accompanying drawings which form a part of this specification, wherein like reference characters designate corresponding parts of the several views.

BRIEF DESCRIPTION OF THE DRAWINGS

FIG. 9 is an end sectional view depicting a quench wheel having a chill surface of V-shaped cross-sectional configuration in contact with the molten material;

FIG. 10 is an end sectional view depicting a quench wheel having a chill surface of planar cross-sectional configuration in contact with the molten material;

FIG. 11 is a vertical sectional view depicting a third embodiment of the invention as incorporated in an overall system of operation;

FIG. 12 is a sectional view taken along the line 12—12 of FIG. 11;

FIG. 13 is a top view of a fourth embodiment of the invention; and

FIG. 14 is a transverse sectional perspective view taken along the line 14—14 of FIG. 13.

DETAILED DESCRIPTION OF THE PREFERRED EMBODIMENTS

For the purpose of this invention, molten material is construed to be any material capable of exhibiting fluid dynamic characteristics similar to those of molten metal wherein the principle of the tidal bore or compression wave applies, i.e. a wave produced in such a fluid is capable of steepening and subsequently toppling over to form a positive surge wave. Further, a filamentary article shall be construed to include both continuous and discrete or discontinuous lengths of material having a flat, circular or other such cross-sectional configuration wherein at least one dimension is within the range of 0.001 to 0.030 inches. These filamentary articles may assume configurations of fibers, ribbons, sheets and other such shapes.

Figure 2:
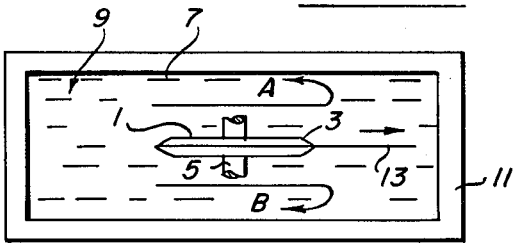
FIG. 2 is a top view of the prior art system of FIG. 1.
Figure 3:
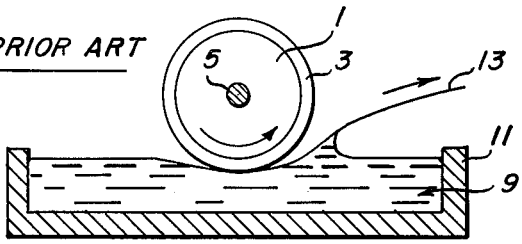
FIG. 3 is a vertical sectional view of the system of FIG. 1 wherein the quench wheel is rotating at an increased velocity.

In the prior art systems for extracting a filamentary article from a source of molten material in the form of an open melt bath, a rotating quench wheel having a peripheral chill surface is lowered towards the bath surface. Upon contacting or "kissing" the surface of the bath, a portion of the melt solidifies on the chill surface and is carried through the bath by the rotation of the quench wheel. Continued rotation of the quench wheel forms an accumulation of molten material above the equilibrium level or surface of the bath immediately adjacent the point where the chill surface of the quench wheel exits the bath. Molten material from this accumulation is chilled to a lower temperature than that of the bath and consequently adheres to the previously formed material on the chill surface of the quench wheel and is removed from the bath through this accumulation. Continuation of this operation produces a solidified filament of the molten material which is thrown up and out of the bath by the centrifugal action of the rotating quench wheel. A typical prior art system utilizing this concept is depicted in FIGS. 1-3.

Figure 1:
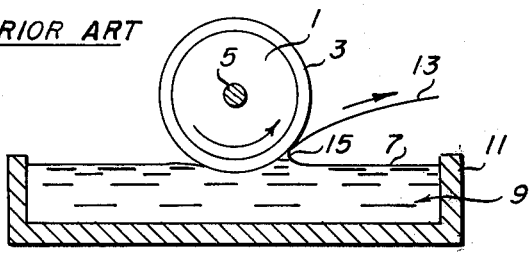
FIG. 1 is a vertical sectional view of a prior art system for producing a filamentary article by rotating a quench wheel in an open bath of molten material.

As shown in FIG. 1, a quench wheel 1 having a peripheral chill surface 3 is mounted for rotation in a counterclockwise direction about a horizontal axis 5. Wheel 1 is supported for vertical movement relative to an open or free surface 7 of a melt 9 that includes a bath of molten material supported within a container 11, such as a crucible or the like. When wheel 1 is rotated and lowered to contact surface 7 of melt 9 by the outermost radial edge of chill surface 3, immediate solidification of melt 9 is effected and a filamentary article 13 formed of solidified melt 9 is centrifugally lifted and thrown away from melt 9 by wheel 1. The production of article 13 is achieved by the formation of a cresting wave 15 of melt 9 which is continuously maintained against chill surface 3 and removed therefrom. This procedure is exemplified by the system disclosed in the aforementioned Maringer et al U.S. Pat. No. 3,904,344, the entire disclosure of which patent is herewith incorporated by reference thereto.

The rotation of quench wheel 1 in melt 9 provides a pumping action which results in fluid turbulence of the molten material. The paths of fluid flow produced by wheel 1 is generally indicated in the directions represented by ARROWS A and B in FIG. 2. Under certain determined maximum rotational velocities, fluid turbulence or instability of bath 9 is maintained under control so that cresting wave 15 formed by wheel 1 is held against chill surface 3 for continuous solidification into article 13. However, in the event that the rotational velocity of wheel 1 exceeds a given maximum, for example, in excess of about 100 feet per second in a bath of molten metal, the corresponding increase in turbulence of bath 9 causes cresting wave 15 to actually move away from its contact with chill surface 3 and stand free on surface 7 of bath 9 forwardly of and away from chill surface 3. Accordingly, when wave 15 loses contact with chill surface 3, the latter ceases to function as the means for solidifying the molten material, thereby terminating continued production of article 13. Because of this inherent phenomenon, melt extraction from an open or free bath by means of a rotating quench wheel has heretofore been necessarily limited to only those velocities below that which will cause the cresting wave to advance away from contact with the chill surface of the wheel for any given molten material being extracted according to this technique.

It is apparent that this situation has severely limited the production rates of filamentary articles according to prior practices since such rates are directly controlled by the maximum rotational velocities of the quench wheel. Only by utilizing rotational velocities far in excess of those heretofore practiced can filament production rate be significantly increased and the thickness of the product be desirably minimized and made much thinner. The present invention achieves this goal and realizes the attendant advantages by providing a system for melt extraction from an open bath by means of a quench wheel wherein the cresting wave of molten material is prevented from advancing forwardly away from the chill surface, notwithstanding the utilization of quench wheel rotational velocities which inevitably caused this undesirable situation in prior art practice.

Figure 4:
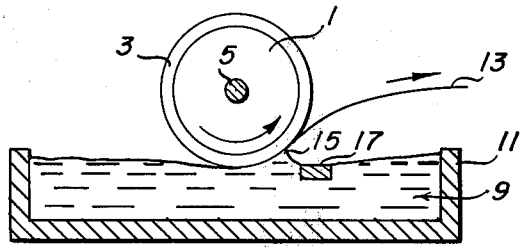
fig-4 PRIOR ART
FIG. 4 is a vertical sectional view of a first embodiment of the invention.
Figure 5:
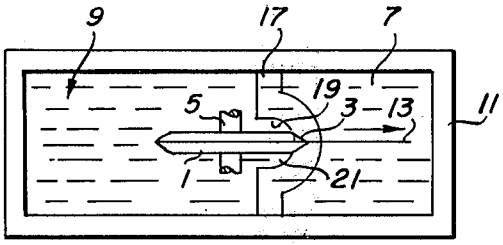
fig-5 PRIOR ART
FIG. 5 is a top view of the system depicted in FIG. 4.

A first embodiment of the invention is depicted in FIGS. 4 and 5 wherein there is shown a means for controlling fluid turbulence in the form of a baffle 17 disposed within melt 9. Baffle 17 is substantially of an arcuate configuration and is disposed just beneath surface 7 of melt 9. When wheel 1 is rotated and lowered to contact surface 7, an inner perimeter 19 of baffle 17 defines a partially enclosed puddle 21 of molten material from which cresting wave 15 is continuously solidified and removed to form article 13. The presence of baffle 17 serves to stabilize the fluid turbulence caused by the pumping action of rotating wheel 1, thereby maintaining wave 15 against chill surface 3. The portion of molten material making up puddle 21 is continuously replenished from below baffle 17. Since wave 15 is prevented from moving forwardly away from chill surface 3 by baffle 17, much higher rotational velocities can be utilized for wheel 1 and correspondingly higher production rates for article 13 are advantageously realized.

Figure 6:
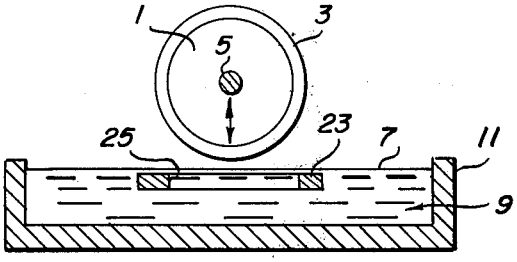
FIG. 6 is a vertical sectional view of a second embodiment of the invention with the quench wheel in a raised position out of contact with the molten material.
Figure 8:
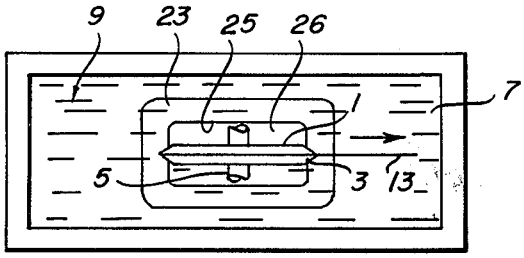
FIG. 8 is a top view of the system as depicted in FIG. 7.
Figure 7:
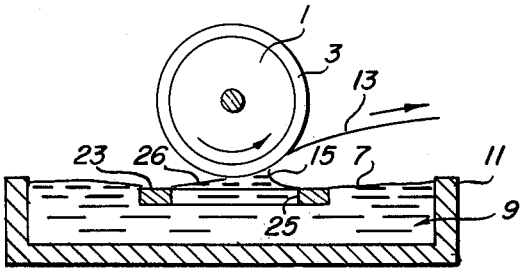
FIG. 7 is a vertical sectional view of the system of FIG. 6 with the quench wheel rotating and in contact with the molten material.

Another embodiment of the invention is shown in FIGS. 6-8. A baffle 23 having a substantially rectangular closed loop configuration is disposed below surface 7 of melt bath 9. An inner perimeter 25 of baffle 23 is also of substantially rectangular configuration. When quench wheel 1 is rotated and lowered to contact the portion of surface 7 disposed directly over the area defined by perimeter 25, a cresting wave 15 of molten material is formed, solidified and removed to produce article 13. Perimeter 25 defines a totally enclosed puddle 26 of molten material which is isolated from the remainder of surface 7 and is free from fluid turbulence normally caused by the pumping action of rotating wheel 1. Molten material is continuously fed to chill surface 3 from below baffle 23 by any suitable molten material supply means.

It is to be understood that baffles 17 and 23 may be of any suitable configuration or secured within bath 9 in any suitable manner for achieving the objectives of defining a stable puddle of molten material for contact by chill surface 3 of quench wheel 1 and maintaining cresting wave 15 against chill surface 3 during high rotational velocities of wheel 1.

The physical changes imparted to surface 7 of bath 9 during rotation of wheel 1 therein are shown in FIGS. 9 and 10. In FIG. 9, quench wheel 1 includes a chill surface 3 having a substantially V-shaped cross-sectional configuration. When the apex 27 of rotating chill surface 3 is caused to contact surface 7 of melt 9, puddle 26 is formed within perimeter 25 of baffle 23. The rotation of wheel 1 causes molten material to flow away from the upper surface of baffle 23. The migration of molten material from the upper surface of baffle 23 causes that portion of surface 7 surrounding an outer perimeter 29 of baffle 23 to rise and define a meniscus-shaped configuration therewith. Similarly, the upper surface of puddle 26 becomes raised in a meniscus-shaped configuration with respect to inner perimeter 25 of baffle 23. Chill surface 3 is thus able to freely form and remove a continuous cresting wave of molten material from puddle 26 at higher than heretofore practiced rotational velocities of wheel 1 since puddle 26 is maintained in a stable and isolated condition by baffle 23.

A quench wheel 31 having a chill surface 33 of a substantially flat or planar cross-sectional configuration is depicted in FIG. 10. The fluid dynamics of melt 9 and physical characteristics of surface 7 are essentially similar to those indicated in the description of FIG. 9. Because of the flat configuration of chill surface 33, filamentary articles having planar configurations, such as ribbons, wide foils or sheets, may be produced from the molten material supplied by puddle 26. The isolation of puddle 26 from the remaining open area of surface 7 is especially advantageous in the extraction of such articles from molten metals since oxides or other reaction products are not permitted to enter puddle 26 and accumulate therein.

When chill surface 33 is utilized and the width thereof is narrower than the width of puddle 26, the width of the solidified article extracted will not exceed the width of surface 33. However, if the width of surface 33 exceeds the width of puddle 26, then the width of the extracted product will not exceed the width of puddle 26. In both situations, the width of the product will decrease with corresponding increase of the rotational velocity of wheel 31.

A third embodiment of the invention is depicted in FIGS. 11 and 12 wherein a mechanical system is utilized for supporting the quench wheel and baffle together as an associated and integral unit. Quench wheel 1 is mounted for rotation on one end of shaft 5. The other end of shaft 5 is provided with a first pulley 35 that is driven by a second pulley 37 through a belt 39. Pulley 37 is directly driven by a variable speed motor 41 supported on a platform 43. An arbor 45 supports shaft 5 and is in turn itself mounted for adjustable vertical movement on a post 47. This is achieved by sliding a sleeve 48 carried by arbor 45 up or down post 47 and securing sleeve 48 in the desired vertical position by a manually-operated threaded latch 51. Platform 43 is also carried by arbor 45 for vertical movement therewith.

A baffle 49 is carried by arbor 45 through a pair of threaded shafts 53 and 55. A mill screw 57 is operatively connected to a pair of gears 59 and 61 threaded on shafts 53 and 55. By rotating screw 57 in the appropriate direction, baffle 49 may be raised towards or lowered away from chill surface 3 of wheel 1. In this manner, exact positioning of wheel 1 with respect to baffle 49 can be achieved prior to the subsequent lowering of wheel 1 and baffle 49 as a unit into bath 9 through actuation of latch 51.

Baffle 49 includes an inner channel-shaped portion 63 having an interior surface 65 which receives molten material from the lower portion of bath 9 and directs it to the upper open end of portion 63 which defines the perimeter and configuration of the puddle formed by rotation of wheel 1. Baffle 49 also includes an annular-shaped molten material storage chamber 67 which defines an open bath surface that surrounds the upper surface of portion 63 during rotation of wheel 1. Molten material is supplied to container 11 from a suitable source, generally indicated at 69. Wheel 1 may further be continuously cooled by a nozzle 71 which directs a supply of fluid coolant in aerosol form, such as aspirated water, onto chill surface 3. Alternatively, wheel 1 may be internally cooled in the same basic manner as disclosed by the Maringer et al U.S. Pat. No. 3,904,344.

A fourth embodiment of a baffle which may be utilized in the practice of the present invention is depicted in FIGS. 13 and 14. A molten material crucible 73 is provided with a channel-shaped baffle 75 disposed therein. Baffle 75 includes a pair of intake ports 77 and 79 at the lower end thereof for receiving molten material contained within the annular space defined by the outer wall of baffle 75 and the inner wall of crucible 73. An upper end 80 of baffle 75 has a height that is below the height of crucible 73 so that molten material may be initially filled to just above upper end 80 of baffle 75. An inner perimeter 81 at upper end 80 of baffle 75 forms and defines a puddle of molten material when a rotating quench wheel is lowered to contact the surface of molten material disposed over upper end 80.

In all the embodiments of the invention as described, the supply of molten material is continuously fed to the puddle formed by the baffle from below the baffle so that the height of the meniscus-shaped puddle is maintained. The rate of molten material feed is maintained in accordance with the extraction rate which is determined by the rotational velocity of the quench wheel.

It is not necessary that the baffle be secured as a stationary fixture in the melt but can also be carried by the supporting structure of the quench wheel so that as the wheel is lowered into the melt, the baffle precedes the wheel into the melt. The distance between the chill surface of the wheel and the top surface of the baffle can be preset or adjusted during production.

The high removal rate of molten material from the puddle formed by the baffle and the comparatively small cross-sectional area of the surface of the puddle which is isolated from the remainder of the bath surface prevents contamination of the wheel chill surface and obviates the necessity of wipers, brushes or other similar prior art implements for maintaining the chill surface clean.

The invention can be utilized for the melt extraction of a variety of molten materials, particularly all the metals and their alloys, which can be contained in a molten state without contamination by the material making up the container or crucible. It has been found that baffles can be constructed of the same material used for making up the crucible. For example, if molten tin is being extracted, it can be effectively contained within a pyrex glass or steel crucible and the baffle can also be made of the same materials. The following TABLE I provides some examples of the various crucible and baffle materials which may be utilized for the melt extraction of some indicated metals.

TABLE I

| Alloy | Crucible Material | Baffle Material |
|---|---|---|
| Sn | pyrex glass, steel, graphite | pyrex glass, steel, graphite |
| Zn | $Al_2O_3$, graphite, W-Mo alloy | $Al_2O_3$, graphite, W-Mo alloy |
| Al | $Al_2O_3$, graphite | $Al_2O_3$, graphite |
| Cu alloys | graphite | graphite |
| Steels (all types) | $Al_2O_3$, MgO | $Al_2O_3$, MgO |

The significant advantages of melt extraction from a baffled puddle of molten material according to the invention are evident from comparative tests conducted wherein the essential criteria for success was the ability to produce a filamentary article in the form of a continuous fiber as a function of rotational velocity of the quench wheel. In these tests, molten tin was used and extracted from a melt bath maintained at a temperature of 10° C. above the melting point of the metal. The crucible for containing the bath and the baffle were made of steel. The baffle was positioned as a fixture within the crucible. The bath of tin was one inch deep and approximately 7¼ inch times 4¼ inch in dimensions.

A copper quench wheel having a width of 1/16 inch and a diameter of 4½ inch and having a chill surface of V-shaped cross-sectional configuration was utilized. The wheel was first rotated in an open bath without a baffle and it was found that a continuous fiber could not be extracted from the bath at rotational velocities greater than 27.6 feet per second. By utilizing a baffle to form a puddle of molten material in accordance with the invention, it was found that the same quench wheel was capable of producing continuous fibers at rotational velocities of about 133 feet per second.

Further tests indicated that higher rotational velocities and production rates were achievable by decreasing the cross-sectional area of the baffle opening or perimeter, thereby reducing the surface area of the puddle formed. The correlation of increase in production rate as a function of decrease in baffle opening area was found to be very similar for various shaped baffle openings. The following TABLE II provides the comparative results of the tests conducted.

TABLE II

| Baffle Opening | | | Continuous fiber prod. | % production increase over open bath |
|---|---|---|---|---|
| Shape | Dimension | Area | ft/sec | |
| Round | 1/8" | .01248 | 116.0 | 320 |
| Round | 1/4" | .050 | 69.6 | 152 |
| Round | 1/2" | .200 | 68.0 | 145 |
| Rectangle | 1/8 × .275 | .0344 | 133.0 | 385 |
| Rectangle | 3/16 × .275 | .052 | 110.0 | 298 |
| Rectangle | 1/4 × .40 | .100 | 96.0 | 248 |
| Open bath | 7-¼ × 4-¼ | 30.8 | 27.6 | 0 |

TABLE II shows the increase in velocity for production of continuous fibers of tin according to the invention as compared with lower production velocities wherein extraction was effected from an open bath in accordance with prior art practice.

In the melt extraction of a fiber from an open bath, it has been shown that the shape of the fiber produced can be changed by the shape of the chill surface of the quench wheel and the depth to which the wheel is inserted in the bath. The basic melt extraction technique permits the production of fibers having a very small cross-sectional area. If a very small V-shaped chill surface is placed on the quench wheel and a minimum insertion of the wheel into the bath is utilized, the effective cross section of the fiber produced will be controlled by the rotational velocity of the quench wheel.

At the high rate of production made possible by the practice of the present invention, fibers having cross-sectional areas of less than 8 times $10^{-7}$ square inch have been consistently produced in 300 and 400 series stainless steel, bronze, carbon steel, zinc, zinc alloys, aluminum, aluminum alloys, tin and tin alloys. All metal alloys which can be held in the molten state and which are capable of being melt extracted have been successfully extracted at higher than heretofore known rates by the practice of this invention.

While the invention has been described and illustrated with reference to certain preferred embodiments and operating parameters, it will be appreciated that various modifications, changes, additions, omissions and substitutions may be resorted to by those skilled in the art and considered to be within the spirit and scope of the invention and the appended claims.

What is claimed is:

1. In a method of melt extraction wherein a solid filamentary article is formed from a bath of molten material having a given surface level by rotating the chill surface of a quench wheel against the surface of the bath to solidify and remove a cresting wave of molten material therefrom, the improvement comprising:

(a) disposing a baffle within the bath wherein at least a majority of the uppermost surface of the baffle is at or below the surface level of the bath; and (b) rotating the chill surface of the quench wheel against the surface of the bath to form at least a partially isolated meniscus puddle with the baffle for:

1. stabilizing fluid turbulence created by the rotating quench wheel, and
2. maintaining the cresting wave of molten material against the chill surface of the quench wheel during its removal.

2. The method of claim 1 wherein the baffle has a substantially arcuate configuration.

3. The method of claim 1 wherein the chill surface has a substantially V-shaped cross-sectional configuration.

4. The method of claim 1 wherein the chill surface has a substantially planar cross-sectional configuration.

5. The method of claim 1 wherein the rotating quench wheel:

(a) forms a puddle of molten material that is substantially completely isolated by the baffle, and (b) removes the cresting wave of molten material from the surface of the meniscus puddle.

6. The method of claim 5 wherein the baffle has a substantially rectangular opening which defines the perimeter of the meniscus puddle.

7. The method of claim 5 wherein the baffle has a substantially circular opening which defines the perimeter of the meniscus puddle.

8. The method of claim 1 further including the step of supplying molten material from beneath the baffle for replenishing the molten material being removed by the quench wheel.

9. The method of claim 5 wherein the width of the chill surface of the quench wheel is greater than the width of the surface of the meniscus puddle.

10. The method of claim 9 wherein the width of the filamentary article being extracted is decreased by increasing the rotational velocity of the quench wheel.

11. The method of claim 5 wherein the width of the chill surface of the quench wheel is less than the width of the surface of the meniscus puddle.

12. The method of claim 5 wherein the bath includes molten metal.

13. The method of claim 12 wherein the metal is selected from the group consisting of carbon steel, stainless steel, aluminum, bronze, zinc, tin and alloys thereof.

14. An apparatus for melt extraction wherein a solid filamentary article is formed from a bath of molten material, which apparatus comprises, in combination:

(a) a container having side walls of a sufficient height for holding molten material having a given bath level, (b) a rotatable quench wheel having a peripheral chill surface for solidifying and removing a cresting wave of the molten material from the bath, (c) means for rotating the quench wheel about its axis of rotation, (d) means for raising and lowering the quench wheel relative to the bath, and (e) baffle means disposed within the container such that at least a majority of the uppermost surface of the baffle means is at or below the given bath level whereby an isolated meniscus puddle of molten material is formed upon rotation of the quench wheel against the surface of the bath to thereby 1. stabilize fluid turbulence created by the rotating quench wheel, and
2. maintain the cresting wave of molten material against the chill surface of the quench wheel during its removal.

15. The apparatus of claim 14 wherein the baffle means has a substantially arcuate configuration.

16. The apparatus of claim 14 wherein the baffle means is carried by the raising and lowering means for permitting the baffle means and the quench wheel to be raised and lowered as a unit relative to the bath.

17. The apparatus of claim 16 further including means to vary the spacing between the peripheral edge of the chill surface and the baffle.

18. The apparatus of claim 14 further including means for maintaining the baffle means stationary within the bath.

19. The apparatus of claim 14 further including means for cooling the chill surface of the quench wheel.

20. The apparatus of claim 14 wherein the chill surface has a substantially V-shaped cross-sectional configuration.

21. The apparatus of claim 14 wherein the chill surface has a substantially planar configuration.

22. The apparatus of claim 14 wherein the baffle includes a hollow channel having a first opening that is disposable directly beneath the point at which the chill surface of the quench wheel contacts the surface of the bath.

23. The apparatus of claim 22 wherein the first opening has a substantially round configuration for defining the perimeter of the meniscus puddle of molten material formed by the rotating quench wheel.

24. The apparatus of claim 22 wherein the first opening has a substantially rectangular configuration for defining the perimeter of the meniscus puddle of molten material formed by the rotating quench wheel.

25. The apparatus of claim 22 wherein the first opening has a substantially elliptical configuration for defining the perimeter of the meniscus puddle of molten material formed by the rotating quench wheel.

26. The apparatus of claim 22 wherein the lower end of the channel includes a second opening for receiving molten material and feeding same to the first opening for removal by the quench wheel.

27. The apparatus of claim 26 wherein the baffle is disposed within a crucible and defines an annular molten material supply chamber therewith.

28. The method of claim 11 wherein the width of the filamentary article extracted is decreased by increasing the rotational velocity of the quench wheel.

* * * * *